US008518867B2

(12) United States Patent
Mayer et al.

(10) Patent No.: US 8,518,867 B2
(45) Date of Patent: Aug. 27, 2013

(54) SOLID TEXTILE AND/OR SKIN CARE COMPOSITION

(75) Inventors: Konstanze Mayer, Duesseldorf (DE); Karl-Heinz Scheffler, Duesseldorf (DE); Rene-Andres Artiga-Gonzalez, Duesseldorf (DE); Mario Sturm, Leverkusen (DE); Tobias Segler, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 382 days.

(21) Appl. No.: 12/246,139

(22) Filed: Oct. 6, 2008

(65) Prior Publication Data

US 2009/0082244 A1 Mar. 26, 2009

Related U.S. Application Data

(63) Continuation of application No. PCT/EP2007/052127, filed on Mar. 7, 2007.

(30) Foreign Application Priority Data

Apr. 6, 2006 (DE) ..... 10 2006 016 575

(51) Int. Cl.
*C11D 3/39* (2006.01)
*C11D 3/40* (2006.01)
*C11D 3/50* (2006.01)

(52) U.S. Cl.
USPC ..... 510/349; 510/515; 510/513; 510/528; 510/516; 510/517; 8/137

(58) Field of Classification Search
USPC ..... 510/515
See application file for complete search history.

(56) References Cited

U.S. PATENT DOCUMENTS

| | | | | |
|---|---|---|---|---|
| 2,594,257 | A | 4/1952 | Durgin | |
| 3,966,629 | A | 6/1976 | Dumbrell | |
| 5,318,714 | A | 6/1994 | Markussen et al. | |
| 5,656,584 | A * | 8/1997 | Angell et al. | 510/441 |
| 6,900,169 | B2 * | 5/2005 | Wasserman et al. | 510/441 |
| 2002/0173434 | A1 * | 11/2002 | Behler et al. | 510/130 |
| 2002/0187414 | A1 * | 12/2002 | Foucher et al. | 430/108.21 |
| 2003/0073603 | A1 * | 4/2003 | Hafkamp et al. | 510/421 |
| 2004/0186039 | A1 * | 9/2004 | Sunder et al. | 510/446 |
| 2005/0170997 | A1 * | 8/2005 | Blyth et al. | 510/515 |
| 2005/0187132 | A1 * | 8/2005 | Blank et al. | 510/446 |
| 2008/0207476 | A1 | 8/2008 | Artiga Gonzalez et al. | |

FOREIGN PATENT DOCUMENTS

| | | | |
|---|---|---|---|
| DE | 10 2004 010 281 | A1 | 9/2005 |
| DE | 102004010281 | A1 * | 9/2005 |
| GB | 2 331 305 | A | 5/1999 |
| WO | WO 02/102950 | A1 | 12/2002 |
| WO | WO 2004/085590 | A1 | 10/2004 |
| WO | WO 2005/005591 | A1 | 1/2005 |
| WO | WO 2005/075620 | A1 | 8/2005 |
| WO | WO 2007/028478 | A1 | 3/2007 |

OTHER PUBLICATIONS

English machine translation of DE 10 2004 010281 to Drillon et al., accessed on May 26, 2010 from the European Patent Office website, esp@cnet, attached as PDF file.*

International Search Report of PCT/EP2007/052127, dated May 21, 2007.

* cited by examiner

*Primary Examiner* — Harold Pyon
*Assistant Examiner* — Katie L Hammer
(74) *Attorney, Agent, or Firm* — RatnerPrestia

(57) ABSTRACT

The invention relates to a solid, textile or skin care composition which comprises a water-soluble carrier, a textile-softening clay and a textile or skin care compound. The invention especially relates to a solid, textile or skin care composition wherein the water-soluble carrier is particulate and is coated with a powder comprising the softening clay and the textile or skin care compound. The invention also relates to textile-softening detergents or cleaning agents which comprise the textile or skin care composition.

17 Claims, No Drawings

SOLID TEXTILE AND/OR SKIN CARE COMPOSITION

CROSS REFERENCE TO RELATED APPLICATIONS

This application is a continuation under 35 U.S.C. §§120 and 365(c) of International Application PCT/EP2007/052127, filed on Mar. 7, 2007. This application also claims priority under 35 U.S.C. §119 of DE 10 2006 016 575.6, filed Apr. 6, 2006. The disclosure of PCT/EP2007/052127 and DE 10 2006 016 575.6 are hereby incorporated by reference in their entirety.

BACKGROUND OF THE INVENTION

The invention relates to a solid, textile and/or skin care composition as well as to its use and manufacture. The invention also relates to a laundry detergent or cleaning agent that comprises the solid, textile and/or skin care composition.

Repeated washing of textiles often causes them to become stiff and to lose their softness. In order to restore their softness/flexibility, to lend them a pleasant fragrance and/or to improve their antistatic properties, the textiles, after the actual washing and cleaning process, are treated with a fabric softener in a subsequent rinse process.

The majority of the commercial fabric softeners are aqueous formulations that comprise a cationic fabric-softening compound having one or two long chain alkyl groups in a molecule as the major active ingredient. Widely used cationic textile-softening compounds include for example methyl-N-(2-hydroxyethyl)-N,N-di(tallowacyloxyethyl)ammonium compounds, methyl-N-(2-hydroxyethyl)-N,N-di(tallowacyloxyethyl)ammonium compounds or N,N-dimethyl-N,N-di(tallowacyloxyethyl)ammonium compounds.

Due to the cationic, textile softening compounds, these conventional fabric softener formulations cannot be used at the same time with the laundry detergent or cleaning agent in the actual washing or cleaning process, because the cationic textile softening compounds interact undesirably with the anionic surfactants of the laundry detergent or cleaning agent. Therefore an additional rinse process is required, which however is time and energy intensive.

A further disadvantage of the conventional fabric softeners is that they do not prevent lime scale residues being deposited on the washing during the rinse step. In addition, the conventional fabric softeners often leave behind unsightly deposits in the dispensing draw of the washing machine.

Problems can also occur with other textile and/or skin care compounds, which for example need to be dosed separately and/or need a separate rinse cycle.

DESCRIPTION OF THE INVENTION

Accordingly, an object of the present invention is to provide a textile and/or skin care composition that can be employed together with laundry detergents or cleaning agents.

This object is achieved by means of a solid, textile and/or skin care composition comprising a water-soluble carrier, a textile-softening clay and a textile or skin care compound.

Such a textile and/or skin care composition can be used in the main wash cycle of an automatic washing or cleaning process. The textile and/or skin care composition can be added, together with the laundry detergent or cleaning agent, in the drum or the dispensing draw of a washing machine. This has the advantage that no additional rinse cycle is required and that no unsightly deposits appear in the dispensing draw. Moreover, this solid composition is easier and better to handle than the liquid compositions as no drops remain on the rim of the bottle, which during subsequent storage of the bottle lead to marks underneath or to unsightly deposits in the area of the closure. The same is true for the case where some of the composition is accidentally spilled when dosing it. As textile-softening clays also exhibit a water-softening effect, additional deposits of lime scale onto the washing are prevented.

Furthermore, it is advantageous that the textile-softening clay and the textile and/or skin care compound are already directly transported onto the washing at the start of the washing process, such that they can develop their full potential.

The water-soluble carrier is preferably selected from the group consisting of inorganic alkali metal salts, organic alkali metal salts, inorganic alkaline earth metal salts, organic alkaline earth metal salts, organic acids, carbohydrates, silicates, urea and mixtures thereof.

These materials are not only inexpensive but dissolve very well in water. Moreover, these materials are odorless.

The water-soluble carrier particularly preferably includes a carbohydrate and is selected from the group consisting of dextrose, fructose, galactose, isoglucose, glucose, saccharose, raffinose and mixtures thereof.

When using a water-soluble carrier that consists of, or at least predominantly consists of carbohydrates, the problem of corrosion in the washing machine, which can occur particularly when using inorganic salts as the water-soluble carrier, is obviated.

The solid, textile and/or skin care composition advantageously comprises 50 to 99 wt. %, preferably 75 to 95 wt. % of the water-soluble carrier.

The solid, textile and/or skin care compound is particularly preferably selected from the group consisting of textile-softening polymers, fluorescence agents, anti-redeposition agents, optical brighteners, graying inhibitors, shrink inhibitors, anti-creasing agents, color transfer inhibitors, antimicrobials, germicides, fungicides, antioxidants, antistats, ironing auxiliaries, UV absorbers, water proofing agents, impregnation agents and mixtures thereof.

Besides softness, a further advantageous effect will be imparted to the textiles treated with the textile and/or skin care composition according to the invention by adding one or more of these textile and/or skin care compounds, or harmful or negative effects that can occur during cleaning and/or conditioning and/or wearing textile fabrics will be reduced, such as for example fading, graying, skin irritations etc.

The textile and/or skin care composition quite particularly preferably comprises a textile-softening polymer, preferably selected from the group consisting of polysiloxanes, cationic polymers and mixtures thereof.

By adding a textile-softening polymer, in particular a polysiloxane, a cationic polymer or a mixture thereof, the textile-softening effect of the textile and/or skin care composition can be further increased.

Further, the textile and/or skin care composition preferably comprises additional ingredients, preferably selected from the group consisting of dyes, perfume, fillers, binders and mixtures thereof. In a particularly preferred embodiment, the solid, textile and/or skin care composition additionally comprises a perfume. In this regard, it is particularly preferred that the quantity of perfume ranges from 0.1 to 20 wt. %, preferably 1 to 10 wt. % and particularly preferably 2 to 7 wt. %.

Textile and/or skin care compositions should most of all also lend a pleasant fragrance to the washing, and for this reason preferably comprise a perfume. The fragrant impression of the washing can be enhanced by the optionally present polysiloxanes and/or cationic polymers in the textile and/or skin care composition. A further advantage of the textile and/or skin care composition according to the invention, which is added in the main wash cycle, is that already directly at the start of the washing and cleaning process, the perfume is transported to the washing and thus can develop its full potential.

Furthermore, for conventional liquid fabric softening compositions containing quaternary ammonium compounds as the textile-softener compound, a problem with the stability of the composition also occurs at higher perfume concentrations (>0.4 wt. % perfume in regular fabric softening compositions and >1 wt. % in concentrated fabric softening compositions). Higher amounts (>1 wt. %) of perfume can be incorporated without difficulty in the textile and/or skin care compositions according to the invention.

It is particularly preferred that the water-soluble carrier is present in particulate form and is coated with a powder including the softening clay and the textile and/or skin care compound. In this context, the particle sizes of the water-soluble carrier are particularly preferably in the range 0.6 to 30 mm, particularly 0.8 to 7 mm and particularly preferably 1 to 3 mm.

This embodiment enables different textile and/or skin care compositions to be easily and quickly comprised as only the composition of the coating powder needs to be changed. The use of a textile and/or skin care compound in the coating powder increases the adhesion of the powder to the carrier. This is particularly the case for liquid textile and/or skin care compounds. When using textile-softening polymers, the softening power of the textile and/or skin care composition can be further increased. This cannot be achieved by a sole increase in the content of textile-softening clay in the coating powder because as of a certain amount of textile-softening clay in the coating powder, the latter will no longer adhere sufficiently to the water-soluble carrier.

Textile and/or skin care compositions with particle sizes in the range 0.8 to 7 mm and particularly preferably in the range 1 to 3 mm can be dosed particularly well and in a controlled manner.

The invention also relates to the use of an inventive solid, textile and/or skin care composition for conditioning textile fabrics.

Moreover, the invention relates to a process for manufacturing a solid, textile and/or skin care composition, including a particulate water-soluble carrier, a textile-softening clay and a textile and/or skin care compound, in which the particulate carrier and the textile-softening clay are mixed in the presence of the textile and/or skin care compound.

The invention further relates to a laundry detergent or cleaning agent, including an inventive solid, textile and/or skin care composition.

By incorporating the inventive textile and/or skin care composition in a laundry detergent or cleaning agent, a softening laundry detergent or cleaning agent ("2 in 1" laundry detergent or cleaning agent) is provided to the consumer, who does not need to dose two compositions. Furthermore, when adding a perfume to the textile and/or skin care composition, the laundry detergent or cleaning agent and the textile and/or skin care composition do not have to be perfumed, rather only one of the two compositions, preferably the textile and/or skin care composition. This not only yields lower costs but it is also advantageous for consumers with sensitive skin and/or allergies. In addition, it is advantageous that laundry detergents or cleaning agents with different textile and/or skin care effects are easily and quickly obtained, as only the composition of the textile and/or skin care composition have to be changed.

The invention is described below in more detail inter alia by means of examples.

The solid, textile and/or skin care composition comprises a water-soluble carrier, a textile-softening clay and a textile and/or skin care compound as the essential ingredients.

The textile and/or skin care composition comprises a textile-softening clay, such as for example a smectite clay. Preferred smectite clays are Beidellite clays, Hectorite clays, Laponite clays, montmorillonite clays, Nontronite clays, Saponite clays, Sauconite clays and mixtures thereof. Montmorillonite clays are the preferred softening clays. Bentonites comprise mainly montmorillonites and can serve as the preferred source for the textile-softening clay.

Suitable Bentonites are for example marketed under the trade names Laundrosil® from Süd-Chemie or under the trade name Detercal® from Laviosa.

The amount of textile-softening clay in the textile and/or skin care composition is between 0.1 and 10 wt. % and is preferably 1 to 5 wt. %.

In addition to the textile-softening clay, the textile and/or skin care composition comprises a textile and/or skin care compound. This is preferably selected from the group consisting of textile-softening polymers, fluorescence agents, anti-redeposition agents, optical brighteners, graying inhibitors, shrink inhibitors, anti-creasing agents, color transfer inhibitors, antimicrobials, germicides, fungicides, antioxidants, antistats, ironing auxiliaries, UV absorbers, water proofing agents, impregnation agents and mixtures thereof. In this context, the textile and/or skin care composition preferably comprises a textile-softening polymer, in particular a polysiloxane and/or a cationic polymer.

A preferred useable polysiloxane possesses at least the following structural units a)

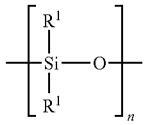

with $R^1$=independently of one another $C_1$-$C_{30}$ alkyl, preferably $C_1$-$C_4$ alkyl, in particular methyl or ethyl, n=1 to 5000, preferably 10 to 2500, in particular 100 to 1500.

It can be preferred that the polysiloxane also possesses the following additional structural units:

b)

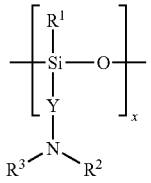

with $R^1$=$C_{1-30}$ alkyl, preferably $C_1$-$C_4$ alkyl, especially methyl or ethyl, Y=optionally substituted, linear or branched $C_1$-$C_{20}$ alkylene, preferably —$(CH_2)_m$— with m=1 to 16, preferably 1 to 8, in particular 2 to 4, especially 3, $R^2$, $R^3$=independently of one another H or optionally substituted, linear or branched $C_1$-$C_{30}$ alkyl, preferably $C_1$-$C_{30}$ alkyl substituted with amino groups, particularly preferably —$(CH_2)_b$—$NH_2$ with b=1 to 10, most preferably b=2, x=1 to 5000, preferably 10 to 2500, especially 100 to 1500.

If the polysiloxane only possesses the structural unit a) with $R^1$=methyl, then it is a polydimethylsiloxane. Polydimethylpolysiloxanes are known as textile-care compounds.

Suitable polydimethysiloxanes include DC-200 (ex Dow Corning), Baysilone® M 50, Baysilone® M 100, Baysilone® M 350, Baysilone® M 500, Baysilone® M 1000, Baysilone® M 1500, Baysilone® M 2000 or Baysilone® M 5000 (all ex GE Bayer Silicones).

It can also be preferred that the polysiloxane comprises the structural units a) and b). A particularly preferred polysiloxane possesses the following structure:

$$(CH_3)_3Si—[O—Si(CH_3)_2]_n—[O—Si(CH_3)\{(CH_2)_3—NH—(CH_2)_2—NH_2\}]_x—OSi(CH_3)_3$$

wherein the sum of n+x is a number between 2 and 10 000.

Suitable polysiloxanes with the structural units a) and b) are commercially available for example under the brand names DC2-8663, DC2-8035, DC2-8203, DC05-7022 or DC2-8566 (all ex Dow Corning). The commercially available products Dow Corning® 7224, Dow Corning® 929 Cationic Emulsion or Formasil 410 (GE Silicones) are likewise suitable according to the invention.

Suitable cationic polymers particularly include those described in "CTFA International Cosmetic Ingredient Dictionary", Fourth Edition, J. M. Nikitakis, et al, Editors, published by the Cosmetic, Toiletry, and Fragrance Association, 1991 and grouped under the general term "polyquaternium". Some of the suitable Polyquaternium compounds are listed below in more detail.

POLYQUATERNIUM-1 (CAS-Number: 68518-54-7)

Definition: $\{(HOCH_2CH_2)_3N^+—CH_2CH=CHCH_2—[N^+(CH_3)_2—CH_2CH=CHCH_2]_X—N^+(CH_2CH_2OH)_3\}[Cl^-]_{x+2}$ POLYQUATERNIUM-2 (CAS-Number: 63451-27-4)

Definition: $[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$ Available for example as Mirapol® A-15 (ex Rhodia)

POLYQUATERNIUM-3

Definition: copolymer of acrylamide and trimethylammoniumethyl methacrylate methosulfate POLYQUATERNIUM-4 (CAS-Number: 92183-41-0)

Definition: copolymer of hydroxyethylcellulose and diallyldimethylammonium chloride Available, for example, as Celquat® H 100 or Celquat® L200 (ex National Starch)

POLYQUATERNIUM-5 (CAS-Number: 26006-22-4)

Definition: copolymer of acrylamide and methacrylyloxyethyltrimethylammonium methosulfate. Available for example as Nalco 7113 (ex Nalco) or Reten® 210, Reten® 220, Reten® 230, Reten® 240, Reten® 1104, Reten® 1105 or Reten® 1106 (all ex Hercules)

POLYQUATERNIUM-6 (CAS-Number: 26062-79-3)

Definition: polymer of dimethyldiallylammonium chloride. Available for example as Merquat® 100 (ex Ondeo-Nalco)

POLYQUATERNIUM-7 (CAS-Number: 26590-05-6)

Definition: polymeric quaternary ammonium salt consisting of acrylamide and dimethyldiallylammonium chloride monomers.

Available for example as Merquat® 550 or Merquat® S (ex Ondeo-Nalco)

POLYQUATERNIUM-8

Definition: polymeric quaternary ammonium salt of methyl and stearyidimethylaminoethyl methacrylate, quaternized with dimethyl sulfate.

POLYQUATERNIUM-9

Definition: polymeric quaternary ammonium salt of polydimethylaminoethyl methacrylate, quaternized with methyl bromide.

POLYQUATERNIUM-10 (CAS-Numbers: 53568-66-4; 55353-19-0; 54351-50-7; 81859-24-7; 68610-92-4; 81859-24-7)

Definition: polymeric quaternary ammonium salt of hydroxyethylcellulose, reacted with a trimethylammonium-substituted epoxide.

Available for example as Celquat® SC-240 (ex National Starch), UCARE® Polymer JR-125, UCARE® Polymer JR-400, UCARE® Polymer JR-30M, UCARE® Polymer LR 400, UCARE® Polymer LR 3OM, Ucare® Polymer SR-10 (all ex Amerchol)

POLYQUATERNIUM-11 (CAS-Number: 53633-54-8)

Definition: quaternary ammonium polymer formed by reacting the copolymer of vinyl pyrrolidone and dimethylaminoethyl methacrylate with diethyl sulfate.

Available for example as Luviquat®PQ 11 PN (ex BASF), Gafquat® 734, Gafquat® 755 or Gafquat® 755N (ex GAF)

POLYQUATERNIUM-12 (CAS-Number: 68877-50-9)

Definition: quaternary ammonium polymer salt, obtained by reacting ethyl methacrylate/abietyl methacrylate/diethylaminoethyl methacrylate copolymer with dimethyl sulfate POLYQUATERNIUM-13 (CAS Number: 68877-47-4)

Definition: polymeric quaternary ammonium salt, obtained by reacting ethyl methacrylate/oleyl methacrylate/diethylaminoethyl methacrylate copolymer with dimethyl sulfate POLYQUATERNIUM-14 (CAS-Number: 27103-90-8)

Definition: polymeric quaternary ammonium salt of the Formula $—\{—CH_2—C—(CH_3)—[C(O)O—CH_2CH_2—N(CH_3)_3—]\}^+_x[CH_3SO_4]^-_x$ POLYQUATERNIUM-15 (CAS-Number: 35429-19-7)

Definition: copolymer of acrylamide and β-methacrylyloxyethyltrimethylammonium chloride POLYQUATERNIUM-16 (CAS-Number: 95144-24-4)

Definition: polymeric quaternary ammonium salt, formed from methylvinylimidazolium chloride and vinyl pyrrolidone Available for example as Luviquat® FC 370, Luviquat® Style, Luviquat® FC 550 or Luviquat® Excellence (all ex BASF)

POLYQUATERNIUM-17 (CAS-Number: 90624-75-2)

Definition: polymeric quaternary ammonium salt, obtained by reacting adipic acid and dimethylaminopropylamine with dichloroethyl ether.

Available for example as Mirapol® AD-1 (ex Rhodia)

POLYQUATERNIUM-18

Definition: polymeric quaternary ammonium salt, obtained by reacting azelaic acid and dimethylaminopropylamine with dichloroethyl ether.

Available for example as Mirapol® AZ-1 (ex Rhodia)

POLYQUATERNIUM-19

Definition: polymeric quaternary ammonium salt, obtained by reacting polyvinyl alcohol with 2,3-epoxypropylamine.

POLYQUATERNIUM-20

Definition: polymeric quaternary ammonium salt, obtained by reacting polyvinyl octadecyl ether with 2,3-epoxypropylamine.

POLYQUATERNIUM-21 (CAS-Number: 102523-94-4)
Definition: polysiloxane/polydimethyldialkylammonium acetate copolymer
Available for example as Abil® B 9905 (ex Goldschmidt-Degussa)
POLYQUATERNIUM-22 (CAS-Number: 53694-17-0)
Definition: dimethyldiallylammonium chloride/acrylic acid copolymer
Available for example as Merquat® 280 (ex Ondeo-Nalco)
POLYQUATERNIUM-24 (CAS-Number: 107987-23-5)
Definition: polymeric quaternary ammonium salt, obtained by reacting hydroxyethylcellulose with a lauryldimethylammonium-substituted epoxide
Available for example as Quatrisoft
POLYQUATERNIUM-27
Definition: block copolymer from the reaction of polyquaternium-2 with polyquaternium-17.
POLYQUATERNIUM-28 (CAS-Number: 131954-48-8)
Definition: vinyl pyrrolidone/methacrylamidopropyltrimethylammonium chloride copolymer
Available for example as Gafquat® HS-100 (ex GAF)
POLYQUATERNIUM-29
Definition: chitosan reacted with propylene oxide and quaternised with epichlorohydrin
POLYQUATERNIUM-30
Definition: polymeric quaternary ammonium salt of the Formula $—[CH_2C(CH_3)(C(O)OCH_3)]_x—[CH_2C(CH_3)(C(O)OCH_2CH_2N^+(CH_3)_2CH_2COO^-)]_y—$
POLYQUATERNIUM-31 (CAS-Number: 136505-02-7)
POLYQUATERNIUM-32 (CAS-Number: 35429-19-7)
Definition: polymer of N,N,N-trimethyl-2-[(2-methyl-1-oxo-2-propenyl)oxy]-ethanaminium chloride with 2-propenamide
POLYQUATERNIUM-37 (CAS-Number: 26161-33-1)
Definition: homopolymer of methacryloyltrimethyl chloride.
Available for example as Synthalen® CR (ex 3V Sigma)
POLYQUATERNIUM-44 (CAS-Number: 150595-70-5)
Definition: quaternary ammonium salt of the copolymer of vinyl pyrrolidone and quaternized imidazoline
Available for example as Luviquat® Ultracare (ex BASF)
POLYQUATERNIUM-68 (CAS-Number: 827346-45-2)
Definition: quaternized copolymer of vinyl pyrrolidone, methacrylamide, vinyl imidazole and quaternized vinyl imidazole
Available for example as Luviquat® Supreme (ex BASF).

Here, the cationic polymers do not only imperatively possess a textile-softening effect, but can also exhibit a skin care effect.

A skin care compound is understood to mean a compound or a mixture of compounds that is absorbed on the textile during contact of a textile with the solid, textile and/or skin care composition, and during contact of the textile with skin lends the skin an advantage compared with a textile that was not treated with the textile and/or skin care composition according to the invention. This advantage can include for example the transfer of the skin care compound from the textile onto the skin, a lower water transfer from the skin to the textile or a lower friction between the surface of the skin and the textile.

The skin care compound is preferably hydrophobic, can be liquid or solid and must be compatible with the other ingredients of the solid, textile and/or skin care composition. The skin care compound can include for example a) waxes such as carnuba, spermaceti, beeswax, lanolin, derivatives thereof as well as their mixtures;
b) plant extracts, for example vegetal oils such as avocado oil, olive oil, palm oil, palm nut oil, rape seed oil, linseed oil, soya oil, peanut oil, coriander oil, castor oil, poppy-seed oil, coconut oil, pumpkin seed oil, wheat germ oil, sesame oil, sunflower oil, almond oil, *macadamia* nut oil, apricot nut oil, hazel nut oil, jojoba oil or canola oil, aloe vera, camomile as well as their mixtures;
c) higher fatty acids such as lauric acid, myristic acid, palmitic acid, stearic acid, behenic acid, oleic acid, linoleic acid, linolenic acid, isostearic acid or polyunsaturated fatty acids;
d) higher fatty alcohols such as lauryl alcohol, cetyl alcohol, stearyl alcohol, oleyl alcohol, behenyl alcohol or 2-hexadecanol,
e) esters, such as cetyl octanoate, lauryl lactate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactates, alkyl citrates and/or alkyl tartrates;
f) hydrocarbons such as paraffins, mineral oils, squalane or squalene;
g) lipids;
h) vitamins such as vitamin A, C or E or vitamin alkyl esters;
i) phospholipids;
j) sun protection agents such as octyl methoxycinnamate and butyl methoxybenzoylmethane;
k) silicone oils such as linear or cyclic polydimethylsiloxanes, amino, alkyl, alkylaryl or aryl-substituted silicone oils and
l) mixtures thereof.

Further suitable textile care compounds preferably include fluorescence agents, anti-redeposition agents, optical brighteners, graying inhibitors, shrink inhibitors, anti-creasing agents, color transfer inhibitors, antimicrobials, germicides, fungicides, antioxidants, antistats, ironing auxiliaries, UV absorbers, water proofing agents, impregnation agents. Specific examples for these textile care compounds are to be found in the description of the laundry detergent or cleaning agent according to the invention and can also be used in the solid, textile and/or skin care composition.

The solid, textile and/or skin care composition can also comprise mixtures of the cited compounds.

The amount of textile and/or skin care compound in the textile and/or skin care composition is 0.1 to 10 wt. % and preferably between 1 and 6 wt. %.

A further essential ingredient of the solid, textile and/or skin care composition is the water-soluble carrier. This preferably includes inorganic alkali metal salts such as for example sodium chloride, potassium chloride, sodium sulfate, sodium carbonate, potassium sulfate, potassium carbonate, sodium hydrogen carbonate, potassium hydrogen carbonate or mixtures thereof, organic alkali metal salts such as for example sodium acetate, potassium acetate, sodium citrate, sodium tartrate or potassium sodium tartrate, inorganic alkaline earth metal salts such as for example calcium chloride or magnesium chloride, organic alkaline earth metal salts such as for example calcium lactate, carbohydrates, organic acids such as for example citric acid or tartaric acid, silicates such as for example water glass, sodium silicate or potassium silicate, urea as well as mixtures thereof. The water-soluble carrier can include in particular a carbohydrate that is selected for example from the group consisting of dextrose, fructose, galactose, isoglucose, glucose, saccharose, raffinose and mixtures thereof. The added carbohydrate can be for example candy sugar or coarse sugar.

The water-soluble carrier can also comprise mixtures of the cited materials.

Preferably, the particle sizes of the water-soluble carrier are in the range 0.6 to 30 mm, particularly 0.8 to 7 mm and particularly preferably 1 to 3 mm. The water-soluble carrier particularly preferably includes saccharose crystals with a particle size of 1 to 2 mm.

It is particularly advantageous when the textile and/or skin care compound is added as a liquid, either in pure form or in the form of a solution, an emulsion or a dispersion, in order to increase the adhesion of the coating to the water-soluble carrier.

The textile and/or skin care composition according to the invention can optionally comprise further ingredients.

In order to enhance the esthetic impression of the textile and/or skin care composition, it may be colored with appropriate colorants. Preferred colorants, which are not difficult for the expert to choose, have high storage stability, are not affected by the other ingredients of the laundry detergent or cleaning agent or by light and do not have any pronounced substantivity for textile fibers, so as not to color them.

Furthermore, the textile and/or skin care composition can comprise a perfume. It is even particularly preferred that the textile and/or skin care composition comprises a perfume.

Suitable perfume oils or fragrances include individual odoriferous compounds, for example synthetic products of the ester, ether, aldehyde, ketone, alcohol and hydrocarbon type. However, mixtures of various odoriferous substances, which together produce an attractive fragrant note, are preferably used. Such perfume oils can also comprise natural mixtures of odoriferous compounds, as are available from vegetal sources.

Preferably, the quantity of perfume in the textile and/or skin care composition ranges between 0.1 and 20 wt. %, particularly preferably between 1 and 10 wt. % and quite particularly preferably between 2 and 7 wt. %.

In addition, the textile and/or skin care composition can comprise a filler, such as silica or salts. The salts can include for example alkali or alkaline earth salts, such as for example sodium sulfate. The amount of filler can range between 0.1 and 10 wt. % and preferably ranges from 1 to 5 wt. %.

In order to increase the gloss, the textile and/or skin care composition can also comprise a pearlizer. Exemplary suitable pearlizers are ethylene glycol mono- and -distearate (for example Cutina® AGS from Cognis) as well as PEG-3-distearate.

The textile and/or skin care composition can also comprise a binder. Suitable binders include for example polyethylene glycols, meltable carbohydrates, polyesters, fatty acids, fatty acid soaps or quaternized ammonium compounds.

For manufacturing the textile and/or skin care composition, the coating powder, including the textile-softening clay and the textile and/or skin care compound as well as optional colorants, perfume, fillers and/or pearlizers, is deposited on the water-soluble carrier in a mixer.

The textile and/or skin care composition is particularly suitable for conditioning textile fabrics and for this it is brought into contact, together with a conventional laundry detergent or cleaning agent, with the textile fabrics in the (main) wash cycle of a conventional washing and cleaning process.

The textile and/or skin care composition can be incorporated into a laundry detergent or cleaning agent.

For this, a solid laundry detergent or cleaning agent is mixed with 0.1 to 20 wt. %, preferably 1 to 10 wt. % of the textile and/or skin care composition according to the invention.

In addition to the textile and/or skin care composition, the laundry detergents or cleaning agents according to the invention comprise surfactant(s), wherein anionic, non-ionic, cationic and/or amphoteric surfactants can be employed. Mixtures of anionic and non-ionic surfactants are preferred from the technical viewpoint. The total surfactant content of a laundry detergent is preferably below 40 wt. % and particularly preferably below 35 wt. %, based on the total laundry detergent.

Preferred non-ionic surfactants are alkoxylated, advantageously ethoxylated, particularly primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may contain e.g. linear and methyl-branched groups in the form of the mixtures typically present in oxo alcohol groups. In particular, however, alcohol ethoxylates with linear alcohol groups of natural origin with 12 to 18 carbon atoms, e.g. from coco-, palm-, tallow- or oleyl alcohol, and an average of 2 to 8 EO per mole alcohol are preferred. Exemplary preferred ethoxylated alcohols include $C_{12-14}$ alcohols with 3 EO, 4EO or 7EO, $C_{9-11}$ alcohol with 7 EO, $C_{13-15}$ alcohols with 3 EO, 5 EO, 7 EO or 8 EO, $C_{12-18}$ alcohols with 3EO, 5EO or 7EO and mixtures thereof, as well as mixtures of $C_{12-14}$ alcohols with 3 EO and $C_{12-18}$ alcohols with 7 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these non-ionic surfactants, fatty alcohols with more than 12 EO can also be used. Examples of these are tallow fatty alcohol with 14 EO, 25 EO, 30 EO or 40 EO. Also, non-ionic surfactants that comprise the EO and PO groups together in the molecule are employable according to the invention. Here, block copolymers with EO-PO blocks or PO-EO blocks can be added, but also EO-PO-EO copolymers or PO-EO-PO copolymers. Of course, mixed alkoxylated non-ionic surfactants can also be used, in which EO- and PO-units are not in blocks but rather distributed statistically. Such products can be obtained by the simultaneous action of ethylene oxide and propylene oxide on fatty alcohols.

Furthermore, as additional non-ionic surfactants, alkyl glycosides that satisfy the general Formula $RO(G)_x$ can be added, where R means a primary linear or methyl-branched, particularly 2-methyl-branched, aliphatic group containing 8 to 22 and preferably 12 to 18 carbon atoms and G stands for a glycose unit containing 5 or 6 carbon atoms, preferably glucose. The degree of oligomerization x, which defines the distribution of monoglycosides and oligoglycosides, is any number between 1 and 10, preferably between 1.2 and 1.4. Alkyl glycosides are known, mild surfactants.

Another class of preferred non-ionic surfactants which may be used, either as the sole non-ionic surfactant or in combination with other non-ionic surfactants are alkoxylated, preferably ethoxylated or ethoxylated and propoxylated fatty acid alkyl esters preferably containing 1 to 4 carbon atoms in the alkyl chain, in particular fatty acid methyl esters.

Non-ionic surfactants of the amine oxide type, for example N-cocoalkyl-N,N-dimethylamine oxide and N-tallow alkyl-N,N-dihydroxyethylamine oxide, and the fatty acid alkanolamides may also be suitable. The quantity in which these non-ionic surfactants are used is preferably no more than the quantity in which the ethoxylated fatty alcohols are used and, particularly no more than half that quantity.

Other suitable surfactants are polyhydroxyfatty acid amides corresponding to the Formula (VII),

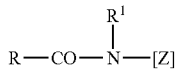

(VII)

in which RCO stands for an aliphatic acyl group with 6 to 22 carbon atoms, $R^1$ for hydrogen, an alkyl or hydroxyalkyl group with 1 to 4 carbon atoms and [Z] for a linear or branched polyhydroxyalkyl group with 3 to 10 carbon atoms and 3 to 10 hydroxyl groups. The polyhydroxyfatty acid amides are known substances, which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to the Formula (VIII),

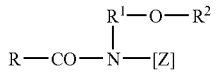

(VIII)

in which R stands for a linear or branched alkyl or alkenyl group containing 7 to 12 carbon atoms, $R^1$ for a linear, branched or cyclic alkyl group or an aryl group containing 2 to 8 carbon atoms and $R^2$ for a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated derivatives of that group.

[Z] is preferably obtained by reductive amination of a sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

The content of non-ionic surfactants in the laundry detergents or cleaning compositions is preferably 5 to 30 wt. %, advantageously 7 to 20 wt. % and particularly 9 to 15 wt. %, in each case based on the total laundry detergent or cleaning agent.

Exemplary suitable anionic surfactants are those of the sulfonate and sulfate type. Suitable surfactants of the sulfonate type are, advantageously $C_{9-13}$ alkylbenzene sulfonates, olefin sulfonates, i.e. mixtures of alkene- and hydroxyalkane sulfonates and disulfonates, as are obtained, for example, from $C_{12-18}$ monoolefins having a terminal or internal double bond, by sulfonation with gaseous sulfur trioxide and subsequent alkaline or acidic hydrolysis of the sulfonation products. Those alkane sulfonates, obtained from $C_{12-18}$ alkanes by sulfochlorination or sulfoxidation, for example, with subsequent hydrolysis or neutralization, are also suitable. The esters of α-sulfofatty acids (ester sulfonates), e.g. the α-sulfonated methyl esters of hydrogenated coco-, palm nut- or tallow acids are likewise suitable.

Further suitable anionic surfactants are sulfated fatty acid esters of glycerine. They include the mono-, di- and triesters and also mixtures of them, such as those obtained by the esterification of a monoglycerine with 1 to 3 moles fatty acid or the transesterification of triglycerides with 0.3 to 2 moles glycerine. Preferred sulfated fatty acid esters of glycerol in this case are the sulfated products of saturated fatty acids with 6 to 22 carbon atoms, for example caproic acid, caprylic acid, capric acid, myristic acid, lauric acid, palmitic acid, stearic acid or behenic acid.

Preferred alk(en)yl sulfates are the alkali metal and especially sodium salts of the sulfuric acid half-esters derived from the $C_{12}$-$C_{18}$ fatty alcohols, for example from coconut butter alcohol, tallow alcohol, lauryl, myristyl, cetyl or stearyl alcohol or from $C_{10}$-$C_{20}$ oxo alcohols and those half-esters of secondary alcohols of these chain lengths. Additionally preferred are alk(en)yl sulfates of the said chain lengths, which contain a synthetic, straight-chained alkyl group produced on a petrochemical basis and which show similar degradation behavior to the suitable compounds based on fat chemical raw materials. The $C_{12}$-$C_{16}$ alkyl sulfates and $C_{12}$-$C_{15}$ alkyl sulfates and $C_{14}$-$C_{15}$ alkyl sulfates are preferred on the grounds of laundry performance. 2,3 alkyl sulfates, which can be obtained from Shell Oil Company under the trade name DAN®, are also suitable anionic surfactants.

Sulfuric acid mono-esters derived from straight-chained or branched $C_{7-21}$ alcohols ethoxylated with 1 to 6 moles ethylene oxide are also suitable, for example 2-methyl-branched alcohols with an average of 3.5 mole ethylene oxide (EO) or $C_{12-18}$ fatty alcohols with 1 to 4 EO. Due to their high foaming performance, they are only used in fairly small quantities in cleaning compositions, for example in amounts of 1 to 5% by weight.

Other suitable anionic surfactants are the salts of alkylsulfosuccinic acid, which are also referred to as sulfosuccinates or esters of sulfosuccinic acid and the monoesters and/or di-esters of sulfosuccinic acid with alcohols, preferably fatty alcohols and especially ethoxylated fatty alcohols. Preferred sulfosuccinates comprise $C_{8-18}$ fatty alcohol groups or mixtures of them. Especially preferred sulfosuccinates contain a fatty alcohol group derived from the ethoxylated fatty alcohols that are under consideration as non-ionic surfactants. Once again the particularly preferred sulfosuccinates are those, whose fatty alcohol groups are derived from ethoxylated fatty alcohols with narrow range homolog distribution. It is also possible to use alk(en)ylsuccinic acids with preferably 8 to 18 carbon atoms in the alk(en)yl chain, or salts thereof.

Particularly preferred anionic surfactants are soaps. Saturated and unsaturated fatty acid soaps are suitable, such as the salts of lauric acid, myristic acid, palmitic acid, stearic acid, (hydrogenated) erucic acid and behenic acid, and especially soap mixtures derived from natural fatty acids such as coconut oil fatty acid, palm kernel oil fatty acid, olive oil fatty acid or tallow fatty acid.

Anionic surfactants, including soaps may be in the form of their sodium, potassium or ammonium salts or as soluble salts of organic bases, such as mono-, di- or triethanolamine. Preferably, the anionic surfactants are in the form of their sodium or potassium salts, especially in the form of the sodium salts.

The content of anionic surfactants in the preferred laundry detergents or cleaning compositions is 2 to 30 wt. %, advantageously 4 to 25 wt. % and particularly 5 to 22 wt. %, in each case based on the total laundry detergent or cleaning agent.

In addition to the textile and/or skin care composition and the surfactants, the laundry detergents and cleaning agents can comprise additional ingredients that further improve the application technological and/or esthetic properties of the laundry detergents or cleaning agents. In the context of the present invention, preferred laundry detergents or cleaning agents comprise one or a plurality of materials from the group of builders, bleaches, bleach activators, enzymes, fragrances, perfume carriers, fluorescence agents, dyes, foam inhibitors, silicone oils, anti-redeposition agents, optical brighteners, graying inhibitors, shrink preventers, anti-crease agents, color transfer inhibitors, antimicrobials, germicides, fungicides, antioxidants, preservatives, corrosion inhibitors, antistats, bitters, ironing aids, water-repellents and impregnation agents, swelling and non-skid agents, neutral filler salts and UV-absorbers.

Silicates, aluminum silicates (particularly zeolites), carbonates, salts of organic di- and polycarboxylic acids as well as mixtures of these materials can be particularly cited as builders that are comprised in the laundry detergents or cleaning agents.

Suitable crystalline, layered sodium silicates correspond to the general formula $NaMSi_xO_{2x+1}$ $H_2O$, wherein M is sodium or hydrogen, x is a number from 1.9 to 4 and y is a number from 0 to 20, preferred values for x being 2, 3 or 4. Preferred crystalline layered silicates of the given formula are those in which M stands for sodium and x assumes the values 2 or 3. In particular, both β- and δ-sodium disilicates $Na_2Si_2O_5$. $yH_2O$ are preferred.

Other useful builders are amorphous sodium silicates with a modulus ($Na_2O$:$SiO_2$ ratio) of 1:2 to 1:3.3, preferably 1:2 to 1:2.8 and more preferably 1:2 to 1:2.6, which dissolve with a delay and exhibit multiple wash cycle properties. The delay in dissolution compared with conventional amorphous sodium silicates can have been obtained in various ways, for example by surface treatment, compounding, compressing/compacting or by over-drying. In the context of this invention, the term "amorphous" also means "X-ray amorphous". In other words, the silicates do not produce any of the sharp X-ray reflections typical of crystalline substances, but at best one or more maxima of the scattered X-radiation, which have a width of several degrees of the diffraction angle. However, particularly good builder properties may even be achieved where the silicate particles produce indistinct or even sharp diffraction maxima in electron diffraction experiments. This can be interpreted to mean that the products have microcrystalline regions between 10 and a few hundred nm in size, values of up to at most 50 nm and especially up to at most 20 nm being preferred. Compacted/densified amorphous silicates, compounded amorphous silicates and over dried X-ray amorphous silicates are particularly preferred.

Of the suitable fine crystalline, synthetic zeolites containing bound water, zeolite A and/or P are preferred. Zeolite MAP® (commercial product of the Crosfield company), is particularly preferred as the zeolite P. However, zeolite X and mixtures of A, X and/or P are also suitable. Commercially available and preferably used in the context of the present invention is, for example, also a co-crystallizate of zeolite X and zeolite A (ca. 80 wt. % zeolite X), which is marketed by the SASOL Company under the trade name VEGOBOND AX® and which can be described by the Formula $$n\mathrm{Na_2O}(1\text{-}n)\mathrm{K_2OAl_2O_3}(2\text{-}2.5)\mathrm{SiO_2}(3.5\text{-}5.5)\mathrm{H_2O}$$

n=0.90-1.0

The zeolite can be employed as the spray-dried powder or also as the non-dried, still moist from its manufacture, stabilized suspension. For the case where the zeolite is added as a suspension, this can comprise small amounts of non-ionic surfactants as stabilizers, for example 1 to 3 wt. %, based on the zeolite, of ethoxylated $C_{12}$-$C_{18}$ fatty alcohols with 2 to 5 ethylene oxide groups, $C_{12}$-$C_{14}$ fatty alcohols with 4 to 5 ethylene oxide groups or ethoxylated isotridecanols. Suitable zeolites have a mean particle size of less than 10 μm (volume distribution, as measured by the Coulter Counter Method) and contain preferably 18 to 22% by weight and more preferably 20 to 22% by weight of bound water.

Naturally, the generally known phosphates can also be added as builders, in so far that their use should not be avoided on ecological grounds. The sodium salts of the orthophosphates, the pyrophosphates and especially the tripolyphosphates are particularly suitable.

Organic builders that can be present in the laundry detergent or cleaning agent include polycarboxylate polymers such as polyacrylates and acrylic acid/maleic acid copolymers, polyaspartates and monomeric polycarboxylates such as citrates, gluconates, succinates or malonates, which are preferably added as the sodium salts.

Among the compounds, which serve as bleaching agents and liberate $H_2O_2$ in water, sodium perborate tetrahydrate and sodium perborate monohydrate are of particular importance. Examples of additional bleaching agents that may be employed are sodium percarbonate, peroxypyrophosphates, citrate perhydrates and $H_2O_2$-liberating peracidic salts or peracids, such as perbenzoates, peroxyphthalates, diperoxyazelaic acid, phthaloimino peracid or diperoxydodecanedioic acid.

The laundry detergents or cleaning compositions can comprise bleach activators in order to achieve an improved bleaching action for washing temperatures of 60° C. and below. Bleach activators, which can be used, are compounds which, under perhydrolysis conditions, yield aliphatic peroxycarboxylic acids having preferably 1 to 10 carbon atoms, in particular 2 to 4 carbon atoms, and/or optionally substituted perbenzoic acid. Substances, which carry O-acyl and/or N-acyl groups of said number of carbon atoms and/or optionally substituted benzoyl groups, are suitable. Preference is given to polyacylated alkylenediamines, in particular tetraacetyl ethylenediamine (TAED), acylated triazine derivatives, in particular 1,5-diacetyl-2,4-dioxohexahydro-1,3,5-triazine (DADHT), acylated glycolurils, in particular tetraacetyl glycoluril (TAGU), N-acylimides, in particular N-nonanoyl succinimide (NOSI), acylated phenolsulfonates, in particular n-nonanoyl- or isononanoyloxybenzene sulfonate (n- or iso-NOBS), carboxylic acid anhydrides, in particular phthalic anhydride, acylated polyhydric alcohols, in particular triacetin, ethylene glycol diacetate and 2,5-diacetoxy-2,5-dihydrofuran.

In addition to, or instead of the conventional bleach activators, so-called bleach catalysts may also be incorporated into the laundry detergents or cleaning agents. These substances are bleach-boosting transition metal salts or transition metal complexes such as, for example, manganese-, iron-, cobalt-, ruthenium- or molybdenum-salen or -carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

The laundry detergent or cleaning agent can comprise encapsulated enzymes and/or enzymes directly in the laundry detergent or cleaning agent. Suitable enzymes are, in particular, those from the classes of hydrolases, such as proteases, esterases, lipases or lipolytic enzymes, amylases, cellulases or other glycosyl hydrolases, hemicellulases, cutinases, β-glucanases, oxidases, peroxidases, perhydrolases and/or laccases and mixtures of the cited enzymes. In the wash, all these hydrolases contribute to the removal of stains such as protein, fat or starchy stains and against graying. Moreover, cellulases and other glycosyl hydrolases can contribute to increased softness of the textile and to color retention by removing pilling and micro fibrils. Oxireductases can also be added for bleaching or for reducing color transfer. Enzymatic active materials obtained from bacterial sources or fungi such as *bacillus subtilis, bacillus licheniformis, streptomyceus griseus* and *humicola insolens* are particularly well suited. Proteases of the subtilisin type and particularly proteases that are obtained from *bacillus lentus*, are preferably used. Here, mixtures of enzymes are of particular interest, for example proteases and amylases or proteases and lipases or lipolytic enzymes or proteases and cellulases or cellulases and lipases or lipolytic enzymes or proteases, amylases and lipases or lipolytic enzymes or proteases, lipases or lipolytic enzymes and cellulases, in particular, however proteases and/or lipase-containing mixtures or mixtures with lipolytic enzymes. Examples of such lipolytic enzymes are the known cutinases. Peroxidases or oxidases have also proved to be suitable in certain cases. The suitable amylases particularly include α-amylases, iso-amylases, pullulanases and pectinases. Cellobiohydrolases, endoglucanases and β-glucosidases, which are also known as cellobiases, or mixtures thereof, are preferred cellulases. As the different cellulase types differ in their CMCase- and avicelase activities, the required activities can be adjusted by means of controlled mixtures of the cellulases.

The enzymes can be adsorbed on carriers in order to protect them against premature decomposition. The content of the enzymes, enzyme mixtures or enzyme granules directly in the laundry detergent or cleaning agent can be, for example, about 0.01 to 5% by weight and is preferably 0.12 to about 2.5% by weight.

However, for example for specific laundry detergents or cleaning agents for consumers with allergies and/or sensitive skin, it can also be preferred that the laundry detergent or cleaning agent does not comprise enzymes.

In one embodiment, the laundry detergent or cleaning agent optionally comprises one or a plurality of perfumes, normally in an amount of up to 10 wt. %, preferably 0.5 to 7 wt. %, particularly 1 to 3 wt. %. Here, the amount of added perfume also depends on the type of the laundry detergent or cleaning agent. However, it is particularly preferred that the perfume is incorporated into the laundry detergent or cleaning agent through the textile and/or skin care composition. However, it is also possible that the laundry detergent or cleaning agent comprises perfume that has not been incorporated into the laundry detergent or cleaning agent through the textile and/or skin care composition.

In order to enhance the esthetic impression of the laundry detergent or cleaning agent, they can be colored (also optionally only partially) with appropriate colorants. Preferred colorants, which are not difficult for the expert to choose, have high storage stability, are not affected by the other ingredients of the laundry detergent or cleaning agent or by light and do not have any pronounced substantivity for textile fibers, so as not to color them.

Soaps, paraffins or silicone oils, optionally deposited on carrier materials, are examples of foam inhibitors that can be incorporated into the laundry detergents or cleaning agents.

Suitable anti-redeposition agents, also referred to as soil repellents, are for example non-ionic cellulose ethers such as methyl cellulose and methyl hydroxypropyl cellulose with a content of methoxy groups of 15 to 30 wt. % and hydroxypropyl groups of 1 to 15 wt. %, each based on the non-ionic cellulose ether, as well as polymers of phthalic acid and/or terephthalic acid or their derivatives known from the prior art, particularly polymers of ethylene terephthalates and/or polyethylene and/or polypropylene glycol terephthalates or anionically and/or non-ionically modified derivatives thereof. Suitable derivatives include the sulfonated derivatives of the phthalic acid polymers and the terephthalic acid polymers. Modified, for example alkoxylated and/or quaternized and/or oxidized polyamines represent a further class of suitable soil release polymers, particularly for cotton-containing textiles. The polyamines are for example polyalkyleneamines, such as polyethyleneamines, or polyalkyleneimines, such as polyethyleneimines. Preferred examples of this class of soil release polymers are ethoxylated polyethyleneimines and ethoxylated polyethyleneamines.

Optical brighteners (so called "whiteners") can be added to the laundry detergents or cleaning agents in order to eliminate graying and yellowing of the treated textile fabrics. These materials absorb onto the fiber and effect a brightening and pseudo bleach effect in that the invisible ultraviolet radiation is converted into visible radiation, wherein the ultraviolet light absorbed from sunlight is irradiated away as weak blue fluorescence and results in pure white for the yellow shade of the grayed or yellowed washing. Suitable compounds derive for example from the substance classes of 4,4'-diamino-2,2'-stilbenedisulfonic acids (flavonic acids), 4,4'-distyrylbiphenylene, methylumbelliferone, coumarone, dihydroquinolinones, 1,3-diarylpyrazolines, naphthoic acid imides, benzoxazole-, benzisoxazole- and benzimidazole-systems as well as heterocyclic substituted pyrene derivatives. The optical brighteners are usually added in amounts between 0% and 0.3 wt. %, based on the finished laundry detergent or cleaning agent.

Graying inhibitors have the function of maintaining the dirt that was removed from the fibers suspended in the washing liquor, thereby preventing the dirt from resettling. Water-soluble colloids of mostly organic nature are suitable for this, for example glue, gelatines, salts of ether sulfonic acids of starches or celluloses, or salts of acidic sulfuric acid esters of celluloses or starches. Water-soluble, acid group-containing polyamides are also suitable for this purpose. In addition, soluble starch preparations and others can be used as the abovementioned starch products, for example degraded starches, aldehyde starches etc. Polyvinyl pyrrolidone can also be used. Preference, however, is given to the use of cellulose ethers such as carboxymethyl cellulose (Na salt), methyl cellulose, hydroxyalkyl cellulose and mixed ethers such as methyl hydroxyethyl cellulose, methyl hydroxypropyl cellulose, methyl carboxymethyl cellulose and mixtures thereof, which can be added, for example in amounts of 0.1 to 5 wt. %, based on the laundry detergent or cleaning agent.

In order to efficiently repress color dissolution and/or the color transfer to other textiles during washing and/or cleaning of colored textiles, the laundry detergent or cleaning agent can comprise a color transfer inhibitor. The color transfer inhibitor is preferably a polymer or copolymer of cyclic amines such as for example vinyl pyrrolidone and/or vinylimidazole. As color transfer inhibitors, suitable polymers include polyvinyl pyrrolidone (PVP), polyvinylimidazole (PVI), copolymers of vinyl pyrrolidone and vinylimidazole (PVP/PVI), polyvinylpyridine-N-oxide, poly-N-carboxymethyl-4-vinylpyridium chloride as well as mixtures of them. Polyvinyl pyrrolidone (PVP), polyvinylimidazole (PVI) or copolymers of vinyl pyrrolidone and vinylimidazole (PVP/PVI) are particularly preferably employed as color transfer inhibitors. The added polyvinyl pyrrolidones (PVP) preferably have an average molecular weight of 2 500 to 400 000 and are commercially available from ISP Chemicals as PVP K 15, PVP K 30, PVP K 60 or PVP K 90 or from BASF as Sokalan® HP 50 or Sokalan® HP 53. The added copolymers of vinyl pyrrolidone and vinylimidazole (PVP/PVI) preferably have a molecular weight in the range 5000 to 100

000. A commercially available PVP/PVI copolymer is for example Sokalan® HP 56 from BASF.

The amount of color transfer inhibitor based on the total weight of the laundry detergent or cleaning agent is preferably 0.01 to 2 wt. %, advantageously from 0.005 to 1 wt. % and more preferably from 0.1 to 0.5 wt. %.

Alternatively however, enzymatic systems, which include a peroxidase and hydrogen peroxide or a substance that generates hydrogen peroxide in water, can also be added as the color transfer inhibitor. The addition of a mediator compound for the peroxidase, for example, an acetosyringone, a phenol derivative or a phenothiazine or phenoxazine is preferred in this case, wherein in addition, the above-mentioned polymeric color transfer inhibitors can also be used.

As textile fabrics, particularly of rayon, spun rayon, cotton and their mixtures tend to crease because the individual fibers are sensitive to flection, bending, pressing and squeezing at right angles to the fiber direction, the laundry detergents or cleaning agents can comprise synthetic anti-crease agents. They include for example synthetic products based on fatty acids, fatty acid esters, fatty acid amides, fatty acid alkylol esters, fatty acid alkylol amides or fatty alcohols that have been mainly treated with ethylene oxide, or products based on lecithin or modified phosphoric acid esters.

The laundry detergents or cleaning agents can comprise antimicrobial agents to control microorganisms. Depending on the antimicrobial spectrum and the action mechanism, antimicrobial agents are differentiated as bacteriostatic agents and bactericides, fungistatic agents and fungicides, etc. Important representatives of these groups are, for example, benzalkonium chlorides, alkylaryl sulfonates, halophenols and phenol mercuric acetate, wherein these compounds can also be totally dispensed with in the inventive laundry detergents or cleaning agents.

The inventive laundry detergents or cleaning agents can comprise preservatives, wherein preferably only those are used, which have no or only a slight skin sensitizing potential. Examples are sorbic acid and its salts, benzoic acid and its salts, salicylic acid and its salts, phenoxyethanol, 3-iodo-2-propynylbutyl carbamate, sodium N-(hydroxymethyl)glycinate, biphenyl-2-ol as well as mixtures thereof. A suitable preservative is illustrated by the solvent-free, aqueous combination of diazolidinyl urea, sodium benzoate and potassium sorbates (obtainable as Euxyl® K 500 ex Schuelke & Mayr), which can be employed in a pH range up to 7.

The agents can comprise antioxidants in order to prevent undesirable changes caused by oxygen and other oxidative processes to the laundry detergents or cleaning agents and/or the treated textile fabrics. This class of compounds includes, for example, substituted phenols, hydroquinones, pyrocatechols and aromatic amines as well as organic sulfides, polysulfides, dithiocarbamates, phosphites, phosphonates and vitamin E.

An increased wear comfort can result from the additional use of antistats that can be included in the laundry detergents or cleaning agents. Antistats increase the surface conductivity and thereby allow an improved discharge of built-up charges. Generally, external antistats are substances with at least one hydrophilic molecule ligand and provide a more or less hygroscopic film on the surfaces. These mainly interface active antistats can be subdivided into nitrogen-containing (amines, amides, quaternary ammonium compounds), phosphorus-containing (phosphoric acid esters) and sulfur-containing (alkyl sulfonates, alkyl sulfates) antistats. Lauryl (or stearyl) dimethyl benzyl ammonium chlorides are suitable antistats for textile fabrics or as additives to laundry detergents or cleaning agents, resulting in an additional finishing effect.

Silicone derivatives, for example, can be incorporated in the laundry detergents or cleaning agent to improve the rewettability of the treated textile fabrics and to facilitate ironing of the treated textile fabrics. By their foam-inhibiting properties, they additionally improve the final rinse behavior of the laundry detergents or cleaning agents. Exemplary preferred silicone derivatives are polydialkylsiloxanes or alkylarylsiloxanes, in which the alkyl groups possess one to five carbon atoms and are totally or partially fluorinated. Preferred silicones are polydimethylsiloxanes that can be optionally derivatized and then are aminofunctional or quaternized or possess Si—OH, Si—H and/or SiCl bonds. The viscosities of the preferred silicones at 25° C. are in the range between 100 and 100 000 mPas, wherein the silicones can be added in amounts between 0.2 and 5 wt. % based on the total laundry detergent or cleaning agent.

Finally, the laundry detergents or cleaning agents can also comprise UV absorbers that are absorbed on the treated textile fabrics and improve the light stability of the fibers. Compounds, which possess these desired properties, are for example, the efficient radiationless deactivating compounds and derivatives of benzophenone having substituents in position(s) 2-and/or 4. Also suitable are substituted benzotriazoles, acrylates, which are phenyl-substituted in position 3 (cinnamic acid derivatives), optionally with cyano groups in position 2, salicylates, organic Ni complexes, as well as natural substances such as umbelliferone and the endogenous urocanic acid.

Substances can be added to complex heavy metals in order to prevent heavy metal catalyzed decomposition of certain detergent ingredients. Suitable heavy metal sequestrants are, for example, the alkali salts of ethylene diamine tetra acetic acid (EDTA) or of nitrilotriacetic acid (NTA) as well as alkali metal salts of anionic polyelectrolytes such as polyacrylates, polymaleates and polysulfonates.

A preferred class of sequestrants are the phosphonates that are comprised in the preferred laundry detergents or cleaning agents in amounts of 0.01 to 2.5 wt. %, preferably 0.02 to 2 wt. % and particularly 0.03 to 1.5 wt. %. These preferred compounds particularly include organophosphonates such as for example 1-hydroxyethane-1,1-diphosphonic acid (HEDP), aminotri(methylenephosphonic acid) (ATMP), diethylenetriamine penta(methylenephosphonic acid) (DTPMP or DETPMP) as well as 2-phosphonobutane-1,2,4-tricarboxylic acid (PBS-AM), which are mainly added in the form of their ammonium or alkali metal salts.

In addition, the solid laundry detergents or cleaning agents can even comprise neutral filler salts such as sodium sulfate or sodium carbonate.

The laundry detergents or cleaning agents according to the invention can be particularly used for cleaning and conditioning textile fabrics.

For manufacturing the laundry detergents or cleaning agents according to the invention, the laundry detergent or cleaning agent is first manufactured without the textile and/or skin care composition using known methods that can include for example drying steps, mixing steps, densification steps, molding steps and/or the subsequent addition of heat-sensitive ingredients (post addition). The resulting product is subsequently blended with a solid, textile and/or skin care composition. For manufacturing molded bodies of laundry detergents or cleaning agents, additional densification and/or molding steps can follow the mixing step.

Inventive textile and/or skin care compositions E1 to E5 are shown in Table 1.

TABLE 1

| | E1 | E2 | E3 | E4 | E5 | E6 |
|---|---|---|---|---|---|---|
| NaCl crystals (5 to 10 mm)- | 79.99 | — | — | — | 89.49 | — |
| Saccharose crystals (3 to 7 mm) | — | 75.99 | 83.99 | 84.99 | — | 67.99 |
| Bentonite | 6 | 5 | 5 | 5 | 5 | 5 |
| Silica | 2 | 5 | 3 | 2 | — | 3 |
| Perfume | 5 | 5 | 7 | 6 | 5 | 6 |
| Polydimethylsiloxane | 7 | 9 | — | — | — | — |
| Polyquaternium-7 | — | — | 1 | — | — | — |
| Polyquaternium-10 | — | — | — | 2 | — | — |
| Tinopal ® CBS-X* | — | — | — | — | 0.5 | — |
| Sodium sulfate | — | — | — | — | — | 18 |
| Colorant | 0.01 | 0.01 | 0.01 | 0.01 | 0.01 | 0.01 |

*ex Ciba

In order to compare the fragrance intensity of a conventional liquid fabric softener (textile-softening diesterquat content of 15 wt. %) with those of the solid, textile and/or skin care compositions E1 and E2, cloth toweling was treated on the one hand with a solid, commercially available laundry detergent and the conventional fabric softener, and on the other hand with the same laundry detergent and respectively the solid textile and/or skin care compositions E1 and E2 in a washing machine (Miele Novotronic W985). After hanging up to dry, the fragrance intensity was determined:

| Composition | Damp, freshly washed laundry | After 1 day on dry laundry | After 7 days on dry laundry |
|---|---|---|---|
| Comparative | 2.2 | 1.4 | 1.4 |
| E1 | 2.7 | 2.0 | 1.7 |
| E2 | 3.0 | 2.4 | 2.1 |

Evaluation: 0 = faint to 4 = strong
Number of evaluators: 7

In addition, in comparison with water, the inventive textile and/or skin care compositions showed a softening effect (after the cloths had been treated with water or with the textile and/or skin care compositions and had been hung up to dry, they were evaluated by a panel of 5 people). In addition, the inventive textile and/or skin care compositions are able to reduce the water hardness. This measurement was carried out with "total hardness test" analysis rods (ex Merck) following the manufacturer's instructions.

An inventive laundry detergent or cleaning agent was manufactured by mixing a solid, unperfumed laundry detergent or cleaning agent with 10 wt. % (based on the finished laundry detergent or cleaning agent) of the textile and/or skin care composition E6.

The inventive laundry detergent or cleaning agent showed good cleaning and conditioning properties.

Lime scale deposits on the washing and/or deposits/residues in the dispensing draw of the washing machine were not observed, either for separate application of the textile and/or skin care composition or when incorporated in a laundry detergent or cleaning agent.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed or as needed to render such methods operative.

Changes in form and substitution of equivalents are contemplated as circumstances may suggest or render expedient. Although specific terms have been employed herein, such terms are intended in a descriptive sense and not for purposes of limitation.

What is claimed is:

1. A particulate textile or skin care composition, comprising a particulate water-soluble carrier, a perfume, a textile-softening clay, and a liquid textile or skin care compound, wherein the water-soluble carrier is coated with a powder comprising the textile-softening clay and the liquid textile or skin-care compound, and wherein the water-soluble carrier consists of an inorganic alkali metal salt selected from the group consisting of sodium chloride, potassium chloride, sodium sulfate, potassium sulfate, and mixtures thereof, an inorganic alkaline earth metal salt selected from the group consisting of calcium chloride, magnesium chloride, and mixtures thereof, a carbohydrate, a urea, or a mixture thereof.

2. The composition of claim 1, wherein the carbohydrate is selected from the group consisting of dextrose, fructose, galactose, isoglucose, glucose, saccharose, raffinose or a mixture thereof.

3. The composition of claim 1, comprising 50 wt % to 99 wt % of a water-soluble carrier.

4. The composition of claim 3, comprising 75 wt % to 95 wt % of a water-soluble carrier.

5. The composition according of claim 1, wherein the textile or skin care compound is a textile-softening polymer, a fluorescence agent, an anti-redeposition agent, an optical brightener, a graying inhibitor, a shrink inhibitor, an anti-creasing agent, a color transfer inhibitor, an antimicrobial, a germicide, a fungicide, an antioxidant, an antistat, an ironing auxiliary, a UV absorber, a water proofing agent, an impregnation agent, or a mixture thereof.

6. The composition of claim 1, comprising a textile-softening polymer.

7. The composition of claim 6, wherein the textile-softening polymer is a polysiloxane, a cationic polymer, or a mixture thereof.

8. The composition of claim 1, further comprising a colorant, a filler, a pearlizer, a binder, or a mixture thereof.

9. The composition of claim 1, comprising 0.1 wt % to 20 wt % of the perfume.

10. The composition of claim 9, comprising 1 wt % to 10 wt % of the perfume.

11. The composition of claim 10, comprising 2 wt % to 7 wt % of the perfume.

12. The composition of claim 1, wherein the water-soluble carrier particles have a size of 0.6 mm to 30 mm.

13. The composition of claim 12, wherein the water-soluble carrier particles have a size of 0.8 mm to 7 mm.

14. The composition of claim 13, wherein the water-soluble carrier particles have a size of 1 mm to 3 mm.

15. A method of conditioning a textile fabric, comprising contacting a textile fabric in need of conditioning with a conditioning affective amount of the composition of claim 1.

16. A laundry detergent or cleaning agent comprising the particulate textile or skin care composition of claim 1.

17. A method of conditioning a textile fabric, comprising contacting a textile fabric in need of conditioning or a conditioning affective amount of the laundry detergent or cleaning agent of claim 16.

* * * * *